US010992050B2

(12) United States Patent
Goto et al.

(10) Patent No.: US 10,992,050 B2
(45) Date of Patent: Apr. 27, 2021

(54) ANTENNA DEVICE AND ARRAY ANTENNA DEVICE

(71) Applicant: Mitsubishi Electric Corporation, Tokyo (JP)

(72) Inventors: Jun Goto, Tokyo (JP); Toru Fukasawa, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/607,668

(22) PCT Filed: May 22, 2017

(86) PCT No.: PCT/JP2017/019042
§ 371 (c)(1),
(2) Date: Oct. 23, 2019

(87) PCT Pub. No.: WO2018/216071
PCT Pub. Date: Nov. 29, 2018

(65) Prior Publication Data

US 2020/0303823 A1 Sep. 24, 2020

(51) Int. Cl.
*H01Q 13/06* (2006.01)
*H01P 3/123* (2006.01)

(52) U.S. Cl.
CPC ..... *H01Q 13/06* (2013.01); *H01P 3/123* (2013.01)

(58) Field of Classification Search
CPC ..... H01Q 13/06; H01Q 21/06; H01P 3/123; H01P 1/171; H01P 1/172; H01P 1/173; H01P 1/161
See application file for complete search history.

(56) References Cited

U.S. PATENT DOCUMENTS 9,947,978 B1 * 4/2018 Tavassoli Hozouri ..... H01P 1/161
2003/0067367 A1 * 4/2003 Volman ..... H01P 1/16 333/125

(Continued)

FOREIGN PATENT DOCUMENTS

JP 11-330801 A 11/1999
JP 2002-94301 A 3/2002

(Continued)

OTHER PUBLICATIONS

Internatioal Search Report (PCT/ISA210) issued in PCT/JP2017/019042, dated Jul. 18, 2017.

(Continued)

*Primary Examiner* — Hoang V Nguyen
(74) *Attorney, Agent, or Firm* — Birch, Stewart, Kolasch & Birch, LLP.

(57) ABSTRACT

Disclosed is an antenna device including a rectangular waveguide (1) having a first opening end (2*a*) and a second opening end (2*b*), a septum phase plate (3) disposed inside the rectangular waveguide (1) in such a way as to partition the first opening end (2*a*) into two parts along a first direction perpendicular to a waveguide axial direction of the rectangular waveguide (1), a width of the septum phase plate in a second direction perpendicular to both the waveguide axial direction of the rectangular waveguide (1) and the first direction becoming narrower stepwise with advancing from the first opening end ($2a_1$, $2a_2$) toward the second opening end (2*b*), and first projecting portions (4*a*, 4*b*) disposed on two respective first inner walls (1*a*, 1*b*) parallel to the septum phase plate (3), out of four inner walls of the rectangular waveguide (1), in such a way as to project toward an inside of the rectangular waveguide (1).

13 Claims, 7 Drawing Sheets

(56) References Cited

U.S. PATENT DOCUMENTS

| | | | | |
|---|---|---|---|---|
| 2013/0120086 | A1* | 5/2013 | Sarasa Delgado | H01P 1/161 333/21 A |
| 2017/0077610 | A1 | 3/2017 | Bongard et al. | |

FOREIGN PATENT DOCUMENTS

| | | | | |
|---|---|---|---|---|
| JP | 2014-127784 | A | 7/2014 | |
| JP | 6031999 | B2 | 11/2016 | |
| WO | WO-2018216210 | A1 * | 11/2018 | H01P 3/123 |

OTHER PUBLICATIONS

Japanese Office Action issued in Application No. 2017-551724, dated Oct. 24, 2017.

Kumar et al., "Novel Dual Circularly Polarized Radiating Element for Spherical Phased-Array Application," IEEE Antennas and Wireless Propagation Letters, vol. 8, 2009, pp. 826-829.

Extended European Search Report issued in corresponding European Application No. 17910879.0 dated Apr. 7, 2020.

Office Action dated Dec. 15, 2020 in corresponding European Patent Application No. 17 910 879.0.

* cited by examiner

ANTENNA DEVICE AND ARRAY ANTENNA DEVICE

TECHNICAL FIELD

The present disclosure relates to an antenna device and an array antenna device that include a septum phase plate inside a rectangular waveguide.

BACKGROUND ART

In Patent Literature 1 mentioned below, an antenna device that includes a septum phase plate inside a rectangular waveguide in order to convert an inputted circularly polarized wave into a linearly polarized wave is disclosed.

In this antenna device, a projecting portion is disposed on an inner wall of the rectangular waveguide in order to shift a resonance frequency in a TM11 mode toward a high frequency and implement band broadening.

The position at which this projecting portion is disposed is in a corner of an inner wall of the rectangular waveguide. Concretely, the position is at a part connecting between an inner wall parallel to the septum phase plate and an inner wall perpendicular to the septum phase plate, out of four inner walls of the rectangular waveguide.

CITATION LIST

Patent Literature

Patent Literature 1: JP 2014-127784 A

SUMMARY OF INVENTION

Technical Problem

Because the conventional antenna device is constituted as above, the axial ratio characteristic of the antenna is determined by the size, the board thickness, and so on of a stair-stepped portion of the septum phase plate. Therefore, the axial ratio characteristic of the antenna can be improved by adjusting designed values such as the size and the board thickness of the stair-stepped portion of the septum phase plate. However, the septum phase plate has an asymmetrical shape, and the asymmetry in terms of the structure of the septum phase plate is a cause of degradation in the axial ratio characteristic. Therefore, a problem is that the axial ratio characteristic of the antenna may be unable to be sufficiently improved even though the designed values, such as the size and the board thickness of the stair-stepped portion of the septum phase plate, are adjusted.

The present disclosure is made in order to solve the above-mentioned problem, and it is therefore an object of the present disclosure to provide an antenna device and an array antenna device capable of reducing degradation in the axial ratio characteristic because of asymmetry in terms of the structure of a septum phase plate, thereby improving the axial ratio characteristic.

Solution to Problem

An antenna device according to the present disclosure includes: a rectangular waveguide having first and second opening ends each to receive or output an electromagnetic wave; a septum phase plate disposed inside the rectangular waveguide in such a way as to partition the first opening end into two parts along a first direction perpendicular to a waveguide axial direction of the rectangular waveguide, a width of the septum phase plate in a second direction perpendicular to both the waveguide axial direction of the rectangular waveguide and the first direction becoming narrower stepwise with advancing from the first opening end toward the second opening end; and two first projecting portions disposed on two respective first inner walls parallel to the septum phase plate, out of four inner walls of the rectangular waveguide, in such a way as to project toward an inside of the rectangular waveguide, wherein each of the two first projecting portions is disposed not to overlap with the septum phase plate in the waveguide axial direction of the rectangular waveguide, and has a shape adjusted in such a manner that a ratio between an electric field strength in the first direction and an electric field strength in the second direction of an electromagnetic wave received by the rectangular waveguide is brought close to 1.

Advantageous Effects of Invention

According to the present disclosure, because the two first projecting portions are disposed on the two respective first inner walls parallel to the septum phase plate, out of the four inner walls of the rectangular waveguide, in such a way as to project toward the inside of the rectangular waveguide, wherein each of the two first projecting portions is disposed not to overlap with the septum phase plate in the waveguide axial direction of the rectangular waveguide, and has the shape adjusted in such a manner that the ratio between the electric field strength in the first direction and the electric field strength in the second direction of the electromagnetic wave received by the rectangular waveguide is brought close to 1, there is provided an advantage of being able to reduce degradation in the axial ratio characteristic because of asymmetry in terms of the structure of the septum phase plate, thereby improving the axial ratio characteristic.

DESCRIPTION OF EMBODIMENTS

Hereafter, in order to explain the present disclosure in greater detail, embodiments of the present disclosure will be described with reference to the accompanying drawings.

Embodiment 1

FIG. 1 is a schematic diagram showing an antenna device according to Embodiment 1 of the present disclosure.

Figure 1A:
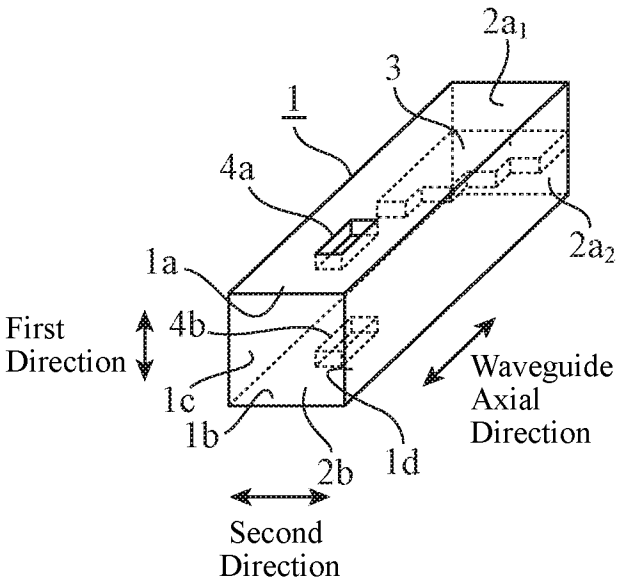
FIG. 1A is a perspective view showing an antenna device according to Embodiment 1 of the present disclosure.
Figure 1B:
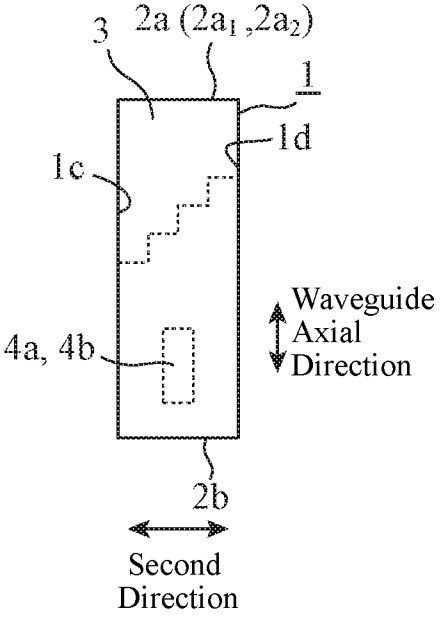
FIG. 1B is a top view showing the antenna device according to Embodiment 1 of the present disclosure.
Figure 1C:
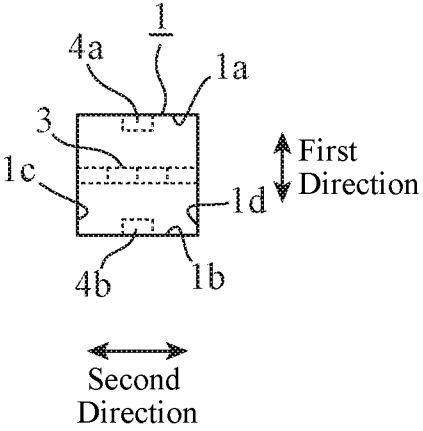
FIG. 1C is a side view showing the antenna device according to Embodiment 1 of the present disclosure.

FIG. 1A is a perspective view showing the antenna device according to Embodiment 1 of the present disclosure, FIG. 1B is a top view showing the antenna device according to Embodiment 1 of the present disclosure, and FIG. 1C is a side view showing the antenna device according to Embodiment 1 of the present disclosure.

In FIG. 1, a rectangular waveguide 1 has a first opening end 2*a* for receiving and outputting an electromagnetic wave and a second opening end 2*b* for receiving and outputting an electromagnetic wave, and is hollow inside.

The first opening end 2*a* is partitioned by a septum phase plate 3 into two parts along a first direction perpendicular to a waveguide axial direction of the rectangular waveguide 1.

In FIG. 1A, out of the two parts of the first opening end 2*a*, a part of the first opening end 2*a* on an upper side of the page is denoted by a reference sign $2a_1$, and a part of the first opening end 2*a* on a lower side of the page is denoted by a reference sign $2a_2$, so that a distinction is made between the two parts.

The aperture shapes of the first opening ends $2a_1$ and $2a_2$ are rectangular.

The aperture shape of the second opening end 2*b* is square.

The rectangular waveguide 1 has four inner walls. Out of the four inner walls, two inner walls parallel to the septum phase plate 3 are first inner walls 1*a* and 1*b*, and two inner walls perpendicular to the first inner walls 1*a* and 1*b* are second inner walls 1*c* and 1*d*.

The septum phase plate 3 is disposed inside the rectangular waveguide 1 in such a way as to partition the first opening end 2*a* into the two parts along the first direction perpendicular to the waveguide axial direction of the rectangular waveguide 1.

In the septum phase plate 3, its width in a second direction perpendicular to both the waveguide axial direction of the rectangular waveguide 1 and the first direction becomes narrower stepwise with advancing from the first opening ends $2a_1$ and $2a_2$ toward the second opening end 2*b*.

A first projecting portion 4*a* is disposed on the first inner wall 1*a* of the rectangular waveguide 1 in such a way as to project toward the inside of the rectangular waveguide 1.

The disposed position of the first projecting portion 4*a* with respect to the first inner wall 1*a* is a central position of the first inner wall 1*a* in the second direction.

The shape of the first projecting portion 4*a* is concave when viewed from the outside of the rectangular waveguide 1, and is convex when viewed from the inside of the rectangular waveguide 1.

A first projecting portion 4*b* is disposed on the first inner wall 1*b* of the rectangular waveguide 1 in such a way as to project toward the inside of the rectangular waveguide 1.

The disposed position of the first projecting portion 4*b* with respect to the first inner wall 1*b* is a central position of the first inner wall 1*b* in the second direction.

The shape of the first projecting portion 4*b* is concave when viewed from the outside of the rectangular waveguide 1, and is convex when viewed from the inside of the rectangular waveguide 1.

Next, operations will be explained.

In this Embodiment 1, the principle of operation in a case in which the antenna device of FIG. 1 is used as a transmitting antenna in a dominant mode in which its operating frequency is the lowest will be explained.

For example, when a linearly polarized wave is incident from the first opening end $2a_1$ of the rectangular waveguide 1, the incident linearly polarized wave is converted into a right-handed circularly polarized wave when passing through the septum phase plate 3 disposed inside the rectangular waveguide.

The right-handed circularly polarized wave after conversion is emitted from the second opening end 2*b* of the rectangular waveguide 1.

FIG. 2 is an explanatory drawing showing the right-handed circularly polarized wave after conversion by the septum phase plate 3.

Figure 2A:
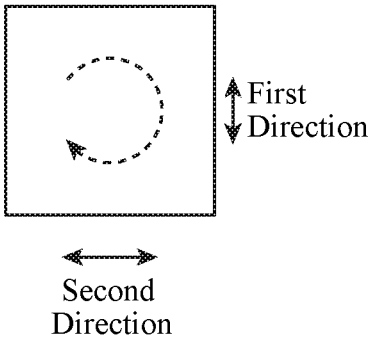
FIG. 2A is an explanatory drawing showing a right-handed circularly polarized wave after conversion by a septum phase plate 3.
Figure 2B:
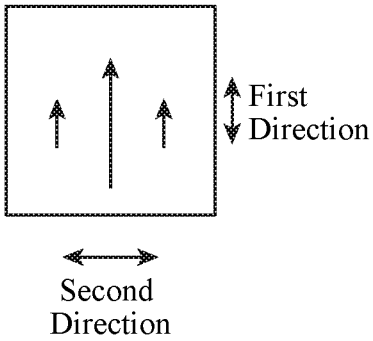
FIG. 2B is an explanatory drawing showing one of two electric field modes included in the right-handed circularly polarized wave.
Figure 2C:
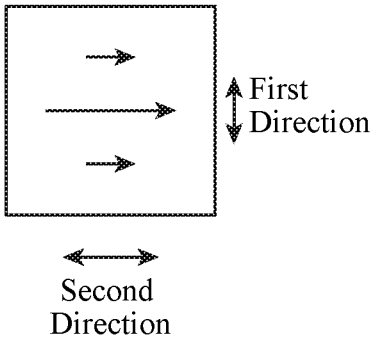
FIG. 2C is an explanatory drawing showing the other one of the two electric field modes included in the right-handed circularly polarized wave.

FIG. 2A shows the right-handed circularly polarized wave after conversion by the septum phase plate 3, FIG. 2B shows one of two electric field modes included in the right-handed circularly polarized wave, and FIG. 2C shows the other one of the two electric field modes included in the right-handed circularly polarized wave.

The phase of the electric field mode shown in FIG. 2C lags behind that of the electric field mode shown in FIG. 2B by 90 degrees, and the right-handed circularly polarized wave is the sum of the electric field mode shown in FIG. 2B and the electric field mode shown in FIG. 2C.

In FIGS. 2B and 2C, the length of each arrow shows the strength of an electric field.

The electric field shown in FIG. 2B is the strongest at the center and becomes weaker with getting closer to both ends in the second direction.

The electric field shown in FIG. 2C is the strongest at the center and becomes weaker with getting closer to both ends in the first direction.

The traveling direction of the right-handed circularly polarized wave extends from this side to the rear side of the page.

As the ratio between the electric field strength shown in FIG. 2B and the electric field strength shown in FIG. 2C becomes closer to 1, the axial ratio characteristic of the antenna becomes better.

The axial ratio characteristic of the antenna can be improved by adjusting designed values such as the size and the board thickness of a stair-stepped portion of the septum phase plate 3. However, because asymmetry in terms of the structure of the septum phase plate 3 is a cause of degradation in the axial ratio characteristic, there is a case in which it is not possible to sufficiently improve the axial ratio characteristic by only adjusting the designed values such as the size and the board thickness of the stair-stepped portion of the septum phase plate 3.

Further, there is a case in which it is not possible to produce the septum phase plate 3 to have a shape as designed, because of a constraint on manufacturing such as a constraint that any drill bit cannot be inserted dependently on the size of the stair-stepped portion of the septum phase plate 3, or a constraint that in order to provide mechanical strength, the board thickness of the septum phase plate 3 must be equal to or larger than a constant value.

Thus, in this Embodiment 1, in addition to improving the axial ratio characteristic of the antenna by adjusting the designed values such as the size and the board thickness of the stair-stepped portion of the septum phase plate 3, by disposing the first projecting portions 4*a* and 4*b*, the degradation in the axial ratio characteristic because of the asymmetry in terms of the structure of the septum phase plate 3 is reduced, so that the axial ratio characteristic is improved.

By disposing the first projecting portions 4*a* and 4*b* and then adjusting the lengths in the first direction, in the second direction, and in the waveguide axial direction of the first projecting portions 4*a* and 4*b*, the electric field strength shown in FIG. 2B can be brought close to the electric field strength shown in FIG. 2C.

As a result, the ratio between the electric field strength shown in FIG. 2B and the electric field strength shown in FIG. 2C can be brought close to 1, so that the axial ratio characteristic of the antenna can be improved.

In this Embodiment 1, the disposed position of the first projecting portion 4*a* with respect to the first inner wall 1*a* is the central position of the first inner wall 1*a* in the second direction, the electric field of the central position being strong. Further, the disposed position of the first projecting portion 4*b* with respect to the first inner wall 1*b* is the central position of the first inner wall 1*b* in the second direction, the electric field of the central position being strong.

Therefore, by disposing the first projecting portions 4*a* and 4*b*, the electric field strength can be efficiently adjusted and the degradation in the axial ratio characteristic because of the asymmetry in terms of the structure of the septum phase plate 3 can be sufficiently reduced.

Note that, in a case where the position at which each of the first projecting portions 4*a* and 4*b* is disposed is in a corner of an inner wall of the rectangular waveguide 1, the electric field of the corner being weak, the electric field strength cannot be efficiently adjusted even though the first projecting portions 4*a* and 4*b* are disposed. Therefore, there is a case where the degradation in the axial ratio characteristic because of the asymmetry in terms of the structure of the septum phase plate 3 cannot be sufficiently reduced.

Figure 3:
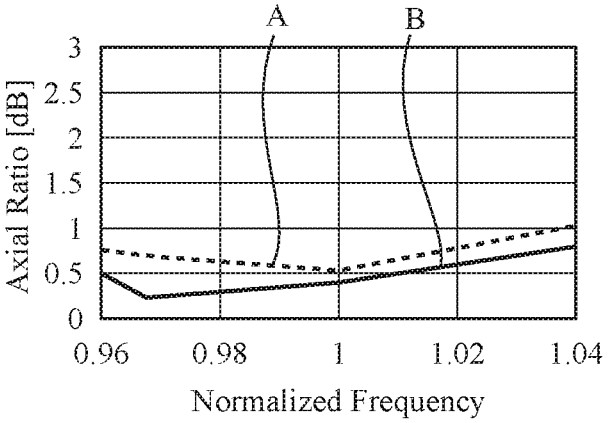
FIG. 3 is an explanatory drawing showing an electromagnetic field simulation result of the axial ratio characteristic in a case in which first projecting portions 4*a* and 4*b* are disposed, and an electromagnetic field simulation result of the axial ratio characteristic in a case in which no first projecting portions 4*a* and 4*b* are disposed.

Here, FIG. 3 is an explanatory drawing showing an electromagnetic field simulation result of the axial ratio characteristic in the case in which the first projecting portions 4*a* and 4*b* are disposed, and an electromagnetic field simulation result of the axial ratio characteristic in the case in which no first projecting portions 4*a* and 4*b* are disposed.

In FIG. 3, A denotes the electromagnetic field simulation result of the axial ratio characteristic in the case in which the first projecting portions 4*a* and 4*b* are disposed, and B denotes the electromagnetic field simulation result of the axial ratio characteristic in the case in which no first projecting portions 4*a* and 4*b* are disposed.

The horizontal axis of FIG. 3 shows a normalized frequency, and the vertical axis of FIG. 3 shows the axial ratio characteristic.

It is seen from FIG. 3 that the axial ratio characteristic in the case in which the first projecting portions 4*a* and 4*b* are disposed gets close to 1 over a wide frequency range as compared with the axial ratio characteristic in the case in which no first projecting portions 4*a* and 4*b* are disposed, and a good axial ratio characteristic is implemented.

As is clear from the above description, according to this Embodiment 1, because the first projecting portions 4*a* and 4*b* are disposed on the two respective first inner walls 1*a* and 1*b* parallel to the septum phase plate 3, out of the four inner walls of the rectangular waveguide 1, in such away as to project toward the inside of the rectangular waveguide 1, there is provided an advantage of being able to reduce the degradation in the axial ratio characteristic because of the asymmetry in terms of the structure of the septum phase plate 3, thereby improving the axial ratio characteristic.

In this Embodiment 1, the example in which a linearly polarized wave incident from the first opening end $\mathbf{2}a_1$ of the rectangular waveguide 1 is converted by the septum phase plate 3 into a right-handed circularly polarized wave, and the right-handed circularly polarized wave is emitted from the second opening end 2*b* of the rectangular waveguide 1 is shown.

For example, when a linearly polarized wave is incident from the first opening end $\mathbf{2}a_2$ of the rectangular waveguide 1, the incident linearly polarized wave is converted into a left-handed circularly polarized wave when passing through the septum phase plate 3 disposed inside the rectangular waveguide.

The left-handed circularly polarized wave after conversion is emitted from the second opening end 2*b* of the rectangular waveguide 1.

Also in this case, because the first projecting portions 4*a* and 4*b* are included, the degradation in the axial ratio characteristic because of the asymmetry in terms of the structure of the septum phase plate 3 can be reduced, so that the axial ratio characteristic can be improved.

Although in this Embodiment 1 the example in which the antenna device of FIG. 1 is used as a transmitting antenna is shown, the antenna device of FIG. 1 may be used as a receiving antenna.

For example, when a right-handed circularly polarized wave is incident from the second opening end 2*b* of the rectangular waveguide 1, the incident right-handed circularly polarized wave is converted into a linearly polarized wave when passing through the septum phase plate 3 disposed inside the rectangular waveguide. The linearly polarized wave after conversion is emitted from the first opening end $2a_1$ of the rectangular waveguide 1.

Further, when a left-handed circularly polarized wave is incident from the second opening end 2*b* of the rectangular waveguide 1, the incident left-handed circularly polarized wave is converted into a linearly polarized wave when passing through the septum phase plate 3 disposed inside the rectangular waveguide. The linearly polarized wave after conversion is emitted from the first opening end $2a_2$ of the rectangular waveguide 1.

Also in these cases, because the first projecting portions 4*a* and 4*b* are included, the degradation in the axial ratio characteristic because of the asymmetry in terms of the structure of the septum phase plate 3 can be reduced, so that the axial ratio characteristic can be improved.

Although in this Embodiment 1 the example in which the antenna device of FIG. 1 is used as a transmitting antenna is shown, a different antenna from the antenna device of FIG. 1 may be connected to the second opening end 2*b* of the rectangular waveguide 1. As the different antenna, for example, a slot antenna or the like can be considered.

Although in this Embodiment 1 the example in which the antenna device of FIG. 1 is used as a transmitting antenna is shown, a feed circuit may be connected to the second opening end 2*b* of the rectangular waveguide 1.

In this case, the antenna device of FIG. 1 can be used not as an antenna, but as a circularly polarized wave generator.

Although in this Embodiment 1 the example in which the rectangular waveguide 1 is hollow inside is shown, the rectangular waveguide may be one into which dielectric is inserted or which is filled with dielectric.

As the rectangular waveguide 1 in this case, for example, a waveguide in which metal plating is provided for surfaces of a dielectric block acquired with injection molding is assumed.

In the case in which dielectric is inserted into the inside of the rectangular waveguide 1 or the inside of the rectangular waveguide is filled with dielectric, the antenna device can be downsized as compared with the case in which the rectangular waveguide is hollow inside, because a wavelength shortening effect using dielectric is provided.

Embodiment 2

In above-mentioned Embodiment 1, the example in which the first projecting portion 4*a* is disposed on the first inner wall 1*a* of the rectangular waveguide 1, and the first projecting portion 4*b* is disposed on the first inner wall 1*b* of the rectangular waveguide 1 is shown.

In this Embodiment 2, an example in which a second projecting portion 4*c* is further disposed on a second inner wall 1*c* of a rectangular waveguide 1, and a second projecting portion 4*d* is further disposed on a second inner wall 1*d* of the rectangular waveguide 1 will be explained.

FIG. 4 is a schematic diagram showing an antenna device according to Embodiment 2 of the present disclosure.

Figure 4A:
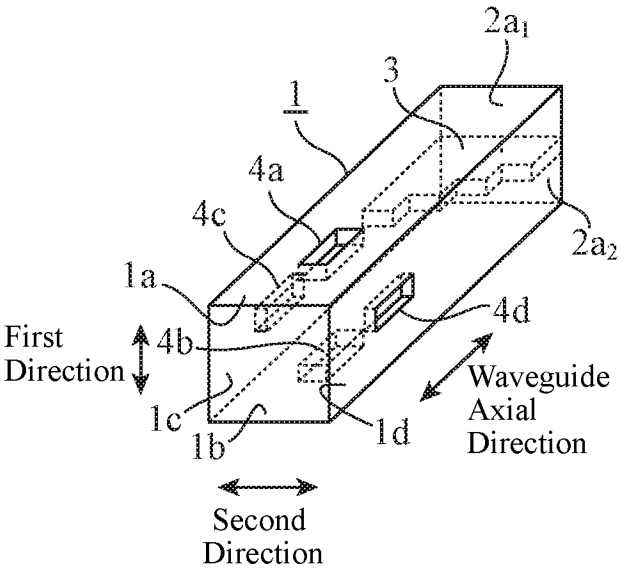
FIG. 4A is a perspective view showing an antenna device according to Embodiment 2 of the present disclosure.
Figure 4B:
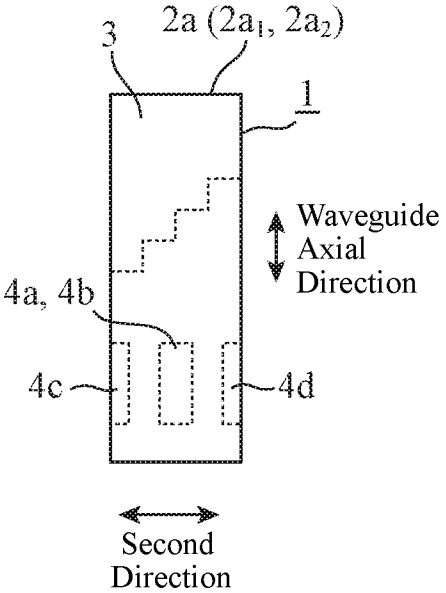
FIG. 4B is a top view showing the antenna device according to Embodiment 2 of the present disclosure.
Figure 4C:
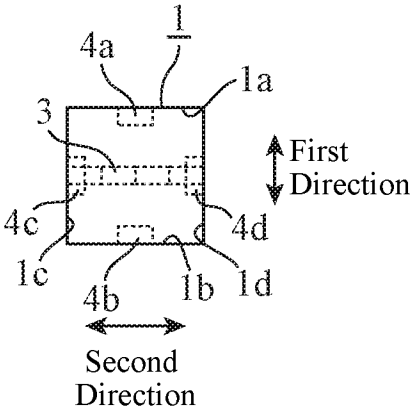
FIG. 4C is a side view showing the antenna device according to Embodiment 2 of the present disclosure.

FIG. 4A is a perspective view showing the antenna device according to Embodiment 2 of the present disclosure, FIG. 4B is a top view showing the antenna device according to Embodiment 2 of the present disclosure, and FIG. 4C is a side view showing the antenna device according to Embodiment 2 of the present disclosure.

In FIG. 4, because the same reference signs as those shown in FIG. 1 denote the same components or like components, an explanation of the components will be omitted hereafter.

The second projecting portion 4*c* is disposed on the second inner wall 1*c* of the rectangular waveguide 1 in such a way as to project toward the inside of the rectangular waveguide 1.

The disposed position of the second projecting portion 4*c* with respect to the second inner wall 1*c* is a central position of the second inner wall 1*c* in a first direction.

The shape of the second projecting portion 4*c* is concave when viewed from the outside of the rectangular waveguide 1, and is convex when viewed from the inside of the rectangular waveguide 1.

The second projecting portion 4*d* is disposed on the second inner wall 1*d* of the rectangular waveguide 1 in such a way as to project toward the inside of the rectangular waveguide 1.

The disposed position of the second projecting portion 4*d* with respect to the second inner wall 1*d* is a central position of the second inner wall 1*d* in the first direction.

The shape of the second projecting portion 4*d* is concave when viewed from the outside of the rectangular waveguide 1, and is convex when viewed from the inside of the rectangular waveguide 1.

Next, operations will be explained.

In this Embodiment 2, in addition to improving the axial ratio characteristic of the antenna by adjusting designed values such as the size and the board thickness of a stair-stepped portion of a septum phase plate 3, by disposing the first projecting portions 4*a* and 4*b* and the second projecting portions 4*c* and 4*d*, degradation in the axial ratio characteristic because of asymmetry in terms of the structure of the septum phase plate 3 is reduced, so that the axial ratio characteristic is improved.

By disposing the first projecting portions 4*a* and 4*b* and then adjusting the lengths in the first direction, in a second direction, and in a waveguide axial direction of the first projecting portions 4*a* and 4*b*, the strength of an electric field shown in FIG. 2B can be adjusted.

Further, by disposing the second projecting portions 4*c* and 4*d* and then adjusting the lengths in the first direction, in the second direction, and in the waveguide axial direction of the second projecting portions 4*c* and 4*d*, the strength of an electric field shown in FIG. 2C can be adjusted.

As a result, the ratio between the electric field strength shown in FIG. 2B and the electric field strength shown in FIG. 2C can be brought close to 1, so that the axial ratio characteristic of the antenna can be improved.

In this Embodiment 2, because not only can the electric field strength shown in FIG. 2B be adjusted, but also the electric field strength shown in FIG. 2C can be adjusted by adjusting the lengths in the first direction, in the second direction, and in the waveguide axial direction of the second projecting portions 4*c* and 4*d*, the ratio between the electric field strength shown in FIG. 2B and the electric field strength shown in FIG. 2C can be brought close to 1 with a higher degree of accuracy than that in above-mentioned Embodiment 1.

In this Embodiment 2, the disposed position of the second projecting portion 4*c* with respect to the second inner wall 1*c* is the central position of the second inner wall 1*c* in the first direction, the electric field of the central position being strong. Further, the disposed position of the second projecting portion 4*d* with respect to the second inner wall 1*d* is the central position of the second inner wall 1*d* in the first direction, the electric field of the central position being strong.

Therefore, by disposing the second projecting portions 4*c* and 4*d*, the electric field strength can be efficiently adjusted and the degradation in the axial ratio characteristic because of the asymmetry in terms of the structure of the septum phase plate 3 can be sufficiently reduced.

As is clear from the above description, according to this Embodiment 2, because the second projecting portions 4*c* and 4*d* are disposed on the two respective second inner walls 1*c* and 1*d* perpendicular to the first inner walls 1*a* and 1*b*, out of the four inner walls of the rectangular waveguide 1, in such a way as to project toward the inside of the rectangular waveguide 1, the ratio between the electric field strength shown in FIG. 2B and the electric field strength shown in FIG. 2C can be brought close to 1 with a higher degree of accuracy than that in above-mentioned Embodiment 1.

Embodiment 3

In above-mentioned Embodiments 1 and 2, the example in which there is no change, with respect to the waveguide axial direction of the rectangular waveguide 1, in the length of each of the first projecting portions 4*a* and 4*b* projecting toward the inside of the rectangular waveguide 1, i.e., the length in the first direction of each of the first projecting portions 4*a* and 4*b* is shown.

In this Embodiment 3, an example in which instead of the first projecting portions 4*a* and 4*b*, first projecting portions 5*a* and 5*b* each of whose length in a first direction changes with respect to a waveguide axial direction of a rectangular waveguide 1 are disposed, will be explained.

FIG. 5 is a schematic diagram showing an antenna device according to Embodiment 3 of the present disclosure.

Figure 5A:
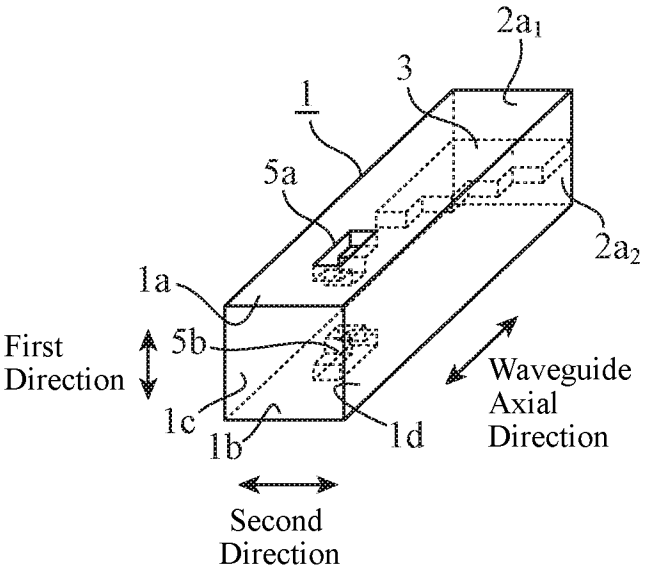
FIG. 5A is a perspective view showing an antenna device according to Embodiment 3 of the present disclosure.
Figure 5B:
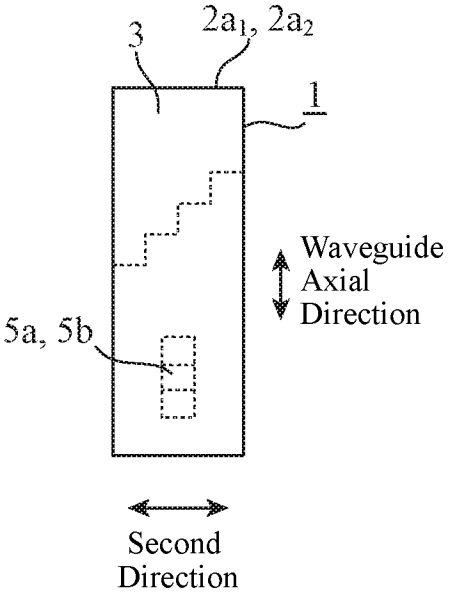
FIG. 5B is a top view showing the antenna device according to Embodiment 3 of the present disclosure.
Figure 5C:
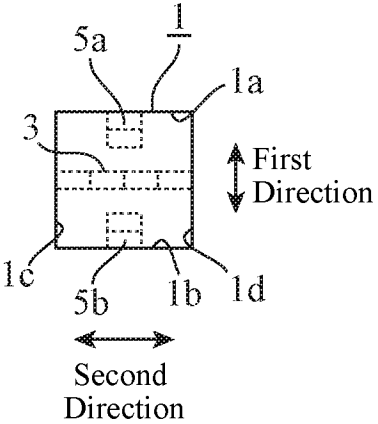
FIG. 5C is a side view showing the antenna device according to Embodiment 3 of the present disclosure.

FIG. 5A is a perspective view showing the antenna device according to Embodiment 3 of the present disclosure, FIG. 5B is a top view showing the antenna device according to Embodiment 3 of the present disclosure, and FIG. 5C is a side view showing the antenna device according to Embodiment 3 of the present disclosure.

In FIG. 5, because the same reference signs as those shown in FIG. 1 denote the same components or like components, an explanation of the components will be omitted hereafter.

The first projecting portion 5*a* is disposed on a first inner wall 1*a* of the rectangular waveguide 1 in such a way as to project toward the inside of the rectangular waveguide 1, like the first projecting portion 4*a* shown in FIG. 1.

The disposed position of the first projecting portion 5*a* with respect to the first inner wall 1*a* is a central position of the first inner wall 1*a* in a second direction.

The length in the first direction of the first projecting portion 5*a* changes with respect to the waveguide axial direction of the rectangular waveguide 1.

The first projecting portion 5*b* is disposed on a first inner wall 1*b* of the rectangular waveguide 1 in such a way as to project toward the inside of the rectangular waveguide 1*i*, like the first projecting portion 4*b* shown in FIG. 1.

The disposed position of the first projecting portion 5*b* with respect to the first inner wall 1*b* is a central position of the first inner wall 1*b* in the second direction.

The length in the first direction of the first projecting portion 5*b* changes with respect to the waveguide axial direction of the rectangular waveguide 1.

FIG. 6 is a side view showing the length in the first direction of each of the first projecting portions 5*a* and 5*b*.

Figure 6A:
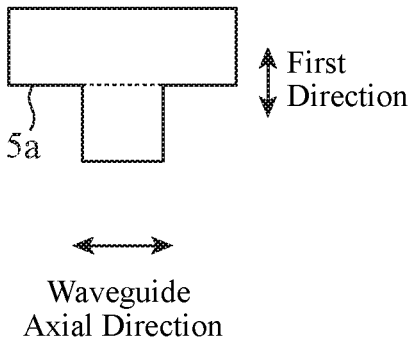
FIG. 6A is a side view showing the length in a first direction of a first projecting portion 5*a;*
Figure 6B:
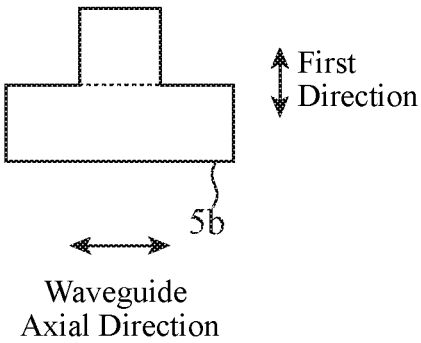
FIG. 6B is a side view showing the length in the first direction of a first projecting portion 5*b;*

FIG. 6A shows the length in the first direction of the first projecting portion 5*a*, and FIG. 6B shows the length in the first direction of the first projecting portion 5*b*.

In FIG. 6, an example in which the length in the first direction of each of the first projecting portions 5*a* and 5*b* changes stepwise with respect to the waveguide axial direction of the rectangular waveguide 1 is shown.

Because the length in the first direction of each of the first projecting portions 5*a* and 5*b* changes stepwise with respect to the waveguide axial direction of the rectangular waveguide 1, discontinuity on each of the first inner walls 1*a* and 1*b* of the rectangular waveguide 1, the discontinuity being caused by the provision of each first projecting portion, is reduced.

As a result, there is provided an advantage of reducing reflection of an electromagnetic wave propagating through the inside of the rectangular waveguide 1, thereby improving the reflection characteristic of the antenna.

FIG. 6 is an example of the stepwise change, and the number of steps in the stepwise change may be any number.

Although the example in which the length in the first direction of each of the first projecting portions 5*a* and 5*b* changes stepwise with respect to the waveguide axial direction of the rectangular waveguide 1 is shown, the length in the first direction of each of the first projecting portions 5*a* and 5*b* may change continuously with respect to the waveguide axial direction of the rectangular waveguide 1, as shown in FIG. 7.

FIG. 7 is a side view showing the length in the first direction of each of the first projecting portions 5*a* and 5*b*.

Figure 7A:
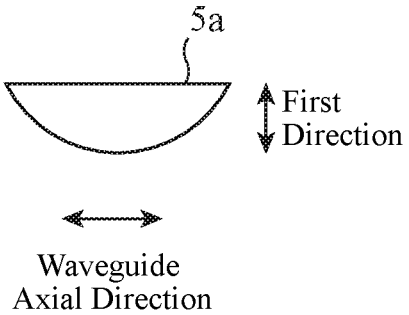
FIG. 7A is a side view showing the length in a first direction of a first projecting portion 5*a;*
Figure 7B:
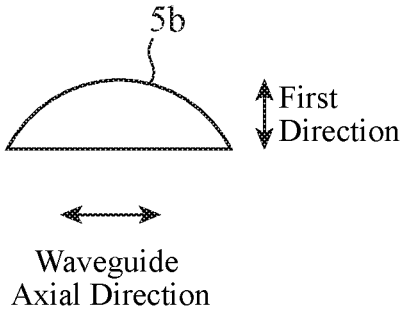
FIG. 7B is a side view showing the length in the first direction of a first projecting portion 5*b;*

FIG. 7A shows the length in the first direction of the first projecting portion 5*a*, and FIG. 7B shows the length in the first direction of the first projecting portion 5*b*.

Because the length in the first direction of each of the first projecting portions 5*a* and 5*b* changes continuously with respect to the waveguide axial direction of the rectangular waveguide 1, the discontinuity on each of the first inner walls 1*a* and 1*b* of the rectangular waveguide 1, the discontinuity being caused by the provision of each first projecting portion, is further reduced.

As a result, there is provided an advantage of reducing reflection of an electromagnetic wave propagating through the inside of the rectangular waveguide 1, thereby improving the reflection characteristic of the antenna.

Further, the length in the first direction of each of the first projecting portions 5*a* and 5*b* may change triangularly with respect to the waveguide axial direction of the rectangular waveguide 1, as shown in FIG. 8.

FIG. 8 is a side view showing the length in the first direction of each of the first projecting portions 5*a* and 5*b*.

Figure 8A:
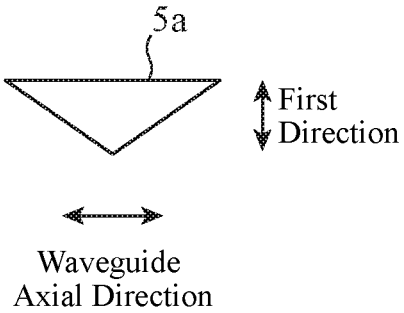
FIG. 8A is a side view showing the length in a first direction of a first projecting portion 5*a;*
Figure 8B:
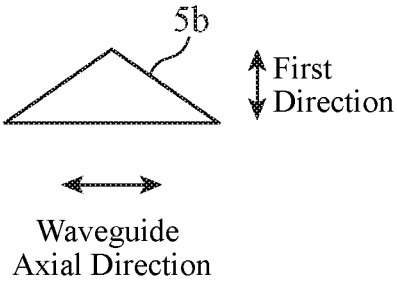
FIG. 8B is a side view showing the length in the first direction of a first projecting portion 5*b;*

FIG. 8A shows the length in the first direction of the first projecting portion 5*a*, and FIG. 8B shows the length in the first direction of the first projecting portion 5*b*.

Also in the case in which the length changes triangularly, the discontinuity on each of the first inner walls 1*a* and 1*b* of the rectangular waveguide 1, the discontinuity being caused by the provision of each first projecting portion, is reduced.

As a result, there is provided an advantage of reducing reflection of an electromagnetic wave propagating through the inside of the rectangular waveguide 1, thereby improving the reflection characteristic of the antenna.

In this Embodiment 3, the example in which instead of the first projecting portions 4*a* and 4*b*, the first projecting portions 5*a* and 5*b* each of whose length in the first direction changes with respect to the waveguide axial direction of the rectangular waveguide 1 are disposed, is shown.

Also, instead of the second projecting portions 4*c* and 4*d* disposed on the second inner walls 1*c* and 1*d* and shown in FIG. 4, second projecting portions 5*c* and 5*d* each of whose length in the second direction changes with respect to the waveguide axial direction of the rectangular waveguide 1 may be disposed.

FIG. 9 is a side view showing the length in the second direction of each of the second projecting portions 5*c* and 5*d*.

Figure 9A:
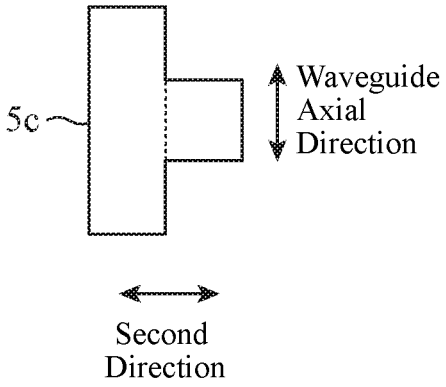
FIG. 9A is a side view showing the length in a second direction of a second projecting portion 5*c;*
Figure 9B:
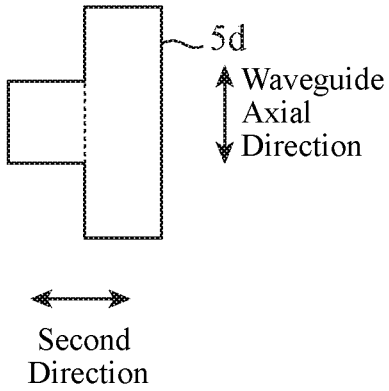
FIG. 9B is a side view showing the length in the second direction of a second projecting portion 5*d;*

FIG. 9A shows the length in the second direction of the second projecting portion 5*c*, and FIG. 9B shows the length in the second direction of the second projecting portion 5*d*.

In FIG. 9, an example in which the length in the second direction of each of the second projecting portions 5*c* and 5*d* changes stepwise with respect to the waveguide axial direction of the rectangular waveguide 1 is shown.

The second projecting portion 5*c* is disposed on the second inner wall 1*c* of the rectangular waveguide 1 in such a way as to project toward the inside of the rectangular waveguide 1, like the second projecting portion 4*c* shown in FIG. 4.

The disposed position of the second projecting portion 5*c* with respect to the second inner wall 1*c* is a central position of the second inner wall 1*c* in the first direction.

The length in the second direction of the second projecting portion 5*c* changes with respect to the waveguide axial direction of the rectangular waveguide 1.

The second projecting portion 5*d* is disposed on the second inner wall 1*d* of the rectangular waveguide 1 in such a way as to project toward the inside of the rectangular waveguide 1, like the second projecting portion 4*d* shown in FIG. 4.

The disposed position of the second projecting portion 5*d* with respect to the second inner wall 1*d* is a central position of the second inner wall 1*d* in the first direction.

The length in the second direction of the second projecting portion 5*d* changes with respect to the waveguide axial direction of the rectangular waveguide 1.

In this case, discontinuity on each of the second inner walls 1*c* and 1*d* of the rectangular waveguide 1, the discontinuity being caused by the provision of each second projecting portion, is reduced.

As a result, there is provided an advantage of reducing reflection of an electromagnetic wave propagating through the inside of the rectangular waveguide 1, thereby improving the reflection characteristic of the antenna.

FIG. 10 is a side view showing the length in the second direction of each of the second projecting portions 5*c* and 5*d*.

Figure 10A:
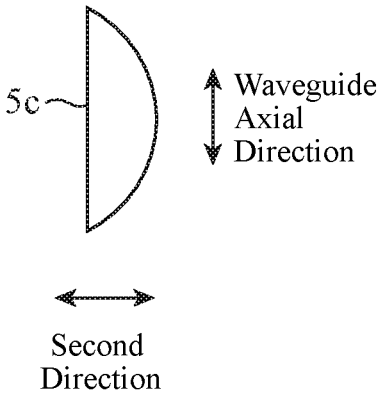
FIG. 10A is a side view showing the length in a second direction of a second projecting portion 5*c;*
Figure 10B:
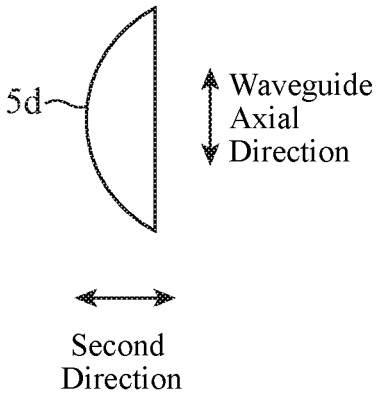
FIG. 10B is a side view showing the length in the second direction of a second projecting portion 5*d;*

FIG. 10A shows the length in the second direction of the second projecting portion 5*c*, and FIG. 10B shows the length in the second direction of the second projecting portion 5*d*.

In FIG. 10, an example in which the length in the second direction of each of the second projecting portions 5*c* and 5*d* changes continuously with respect to the waveguide axial direction of the rectangular waveguide 1 is shown.

FIG. 11 is a side view showing the length in the second direction of each of the second projecting portions 5*c* and 5*d*.

Figure 11A:
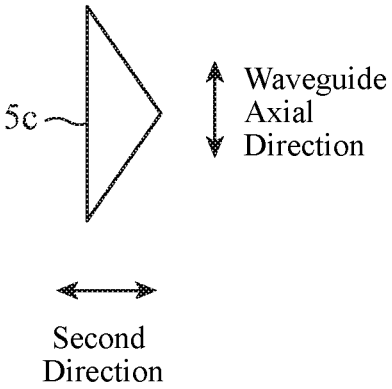
FIG. 11A is a side view showing the length in a second direction of a second projecting portion 5*c;*
Figure 11B:
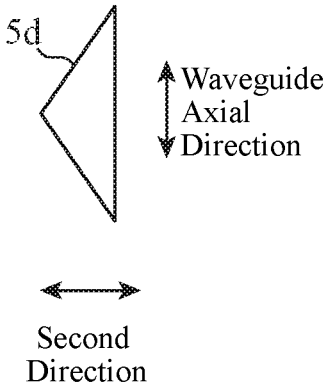
FIG. 11B is a side view showing the length in the second direction of a second projecting portion 5*d*.

FIG. 11A shows the length in the second direction of the second projecting portion 5*c*, and FIG. 11B shows the length in the second direction of the second projecting portion 5*d*.

In FIG. 11, an example in which the length in the second direction of each of the second projecting portions 5*c* and 5*d* changes triangularly with respect to the waveguide axial direction of the rectangular waveguide 1 is shown.

Also in the cases of FIGS. 10 and 11, the discontinuity on each of the second inner walls 1*c* and 1*d* of the rectangular waveguide 1, the discontinuity being caused by the provision of each second projecting portion, is reduced.

As a result, there is provided an advantage of reducing reflection of an electromagnetic wave propagating through the inside of the rectangular waveguide 1, thereby improving the reflection characteristic of the antenna.

Embodiment 4

Figure 12:
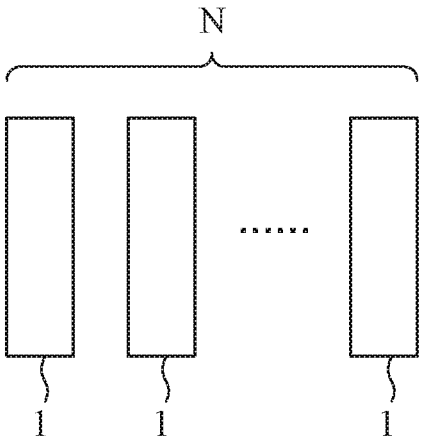
FIG. 12 is a schematic diagram showing an array antenna device according to Embodiment 4 of the present disclosure.

Although in above-mentioned Embodiments 1 to 3 the example in which the antenna device is used alone is assumed, the antenna device of FIG. 1, 4, or 5 may be used as an array antenna device arranged in which multiple antenna devices are arranged as shown in FIG. 12.

FIG. 12 is a schematic diagram showing the array antenna device according to Embodiment 4 of the present disclosure.

In FIG. 12, an example in which N antenna devices each of which is the one of FIG. 1, 4, or 5 (N is an integer equal to or greater than 2) are arranged is shown.

By independently supplying an electromagnetic wave to the rectangular waveguide 1 of each of the antenna devices, beam scanning in any direction can be achieved.

It is to be understood that any combination of two or more of the above-mentioned embodiments can be made, various changes can be made in any component according to any one of the above-mentioned embodiments, and any component according to any one of the above-mentioned embodiments can be omitted within the scope of the present disclosure.

INDUSTRIAL APPLICABILITY

The present disclosure is suitable for an antenna device and an array antenna device that include a septum phase plate inside a rectangular waveguide.

REFERENCE SIGNS LIST

1 rectangular waveguide, 1*a*, 1*b* first inner wall, 1*c*, 1*d* second inner wall, 2*a*, $2a_1$, $2a_2$ first opening end, 2*b* second opening end, 3 septum phase plate, 4*a*, 4*b* first projecting portion, 4*c*, 4*d* second projecting portion, 5*a*, 5*b* first projecting portion, and 5*c*, 5*d* second projecting portion.

The invention claimed is:

1. An antenna device comprising:

a rectangular waveguide having first and second opening ends each to receive or output an electromagnetic wave;

a septum phase plate disposed inside the rectangular waveguide in such a way as to partition the first opening end into two parts along a first direction perpendicular to a waveguide axial direction of the rectangular waveguide, a width of the septum phase plate in a second direction perpendicular to both the waveguide axial direction of the rectangular waveguide and the first direction becoming narrower stepwise with advancing from the first opening end toward the second opening end; and two first projecting portions disposed on two respective first inner walls parallel to the septum phase plate, out of four inner walls of the rectangular waveguide, in such a way as to project toward an inside of the rectangular waveguide, wherein a disposed position of each of the first projecting portions with respect to the corresponding first inner wall is a central position of the corresponding first inner wall in the second direction, wherein each of the two first projecting portions is disposed not to overlap with the septum phase plate in the waveguide axial direction of the rectangular waveguide, and has a shape adjusted in such a manner that a ratio between an electric field strength in the first direction and an electric field strength in the second direction of an electromagnetic wave received by the rectangular waveguide is brought close to 1.

2. The antenna device according to claim 1, wherein an aperture shape of the second opening end is square, and an aperture shape of each of the two parts of the first opening end partitioned by the septum phase plate is rectangular.

3. The antenna device according to claim 1, comprising two second projecting portions disposed on two respective second inner walls perpendicular to the first inner walls, out of the four inner walls of the rectangular waveguide, in such a way as to project toward the inside of the rectangular waveguide, wherein each of the two second projecting portions is disposed not to overlap with the septum phase plate in the waveguide axial direction of the rectangular waveguide.

4. The antenna device according to claim 3, wherein a disposed position of each of the second projecting portions with respect to the corresponding second inner wall is a central position of the corresponding second inner wall in the first direction.

5. The antenna device according to claim 3, wherein in each of the second projecting portions, a length of a part thereof projecting toward the inside of the rectangular waveguide changes with respect to the waveguide axial direction of the rectangular waveguide.

6. The antenna device according to claim 5, wherein in each of the second projecting portions, the length of the part projecting toward the inside of the rectangular waveguide changes stepwise with respect to the waveguide axial direction of the rectangular waveguide.

7. The antenna device according to claim 5, wherein in each of the second projecting portions, the length of the part projecting toward the inside of the rectangular waveguide changes continuously with respect to the waveguide axial direction of the rectangular waveguide.

8. The antenna device according to claim 5, wherein in each of the second projecting portions, the length of the part projecting toward the inside of the rectangular waveguide changes triangularly with respect to the waveguide axial direction of the rectangular waveguide.

9. The antenna device according to claim 1, wherein in each of the first projecting portions, a length of a part thereof projecting toward the inside of the rectangular waveguide changes with respect to the waveguide axial direction of the rectangular waveguide.

10. The antenna device according to claim 9, wherein in each of the first projecting portions, the length of the part projecting toward the inside of the rectangular waveguide changes stepwise with respect to the waveguide axial direction of the rectangular waveguide.

11. The antenna device according to claim 9, wherein in each of the first projecting portions, the length of the part projecting toward the inside of the rectangular waveguide changes continuously with respect to the waveguide axial direction of the rectangular waveguide.

12. The antenna device according to claim 9, wherein in each of the first projecting portions, the length of the part projecting toward the inside of the rectangular waveguide changes triangularly with respect to the waveguide axial direction of the rectangular waveguide.

13. An array antenna device in which multiple antenna devices are arranged, each of the antenna devices comprising:

a rectangular waveguide having first and second opening ends each to receive or output an electromagnetic wave;

a septum phase plate disposed inside the rectangular waveguide in such a way as to partition the first opening end into two parts along a first direction perpendicular to a waveguide axial direction of the rectangular waveguide, a width of the septum phase plate in a second direction perpendicular to both the waveguide axial direction of the rectangular waveguide and the first direction becoming narrower stepwise with advancing from the first opening end toward the second opening end; and two first projecting portions disposed on two respective first inner walls parallel to the septum phase plate, out of four inner walls of the rectangular waveguide, in such a way as to project toward an inside of the rectangular waveguide, wherein a disposed position of each of the first projecting portions with respect to the corresponding first inner wall is a central position of the corresponding first inner wall in the second direction, wherein each of the two first projecting portions is disposed not to overlap with the septum phase plate in the waveguide axial direction of the rectangular waveguide, and has a shape adjusted in such a manner that a ratio between an electric field strength in the first direction and an electric field strength in the second direction of an electromagnetic wave received by the rectangular waveguide is brought close to 1.

* * * * *